US010508523B2

(12) United States Patent
McConaghy et al.

(10) Patent No.: US 10,508,523 B2
(45) Date of Patent: Dec. 17, 2019

(54) USING LIQUEFIED PETROLEUM GAS IN A HOT CIRCULATING FLUID HEATER FOR IN-SITU OIL SHALE RETORTING

(71) Applicant: American Shale Oil, LLC, Newark, NJ (US)

(72) Inventors: James R. McConaghy, Salida, CO (US); Alan K. Burnham, Livermore, CA (US)

(73) Assignee: American Shale Oil, LLC, Newark, NJ (US)

( * ) Notice: Subject to any disclaimer, the term of this patent is extended or adjusted under 35 U.S.C. 154(b) by 253 days.

(21) Appl. No.: 14/767,268

(22) PCT Filed: Feb. 12, 2014

(86) PCT No.: PCT/US2014/016106

§ 371 (c)(1),
(2) Date: Aug. 11, 2015

(87) PCT Pub. No.: WO2014/127045

PCT Pub. Date: Aug. 21, 2014

(65) Prior Publication Data

US 2015/0369026 A1 Dec. 24, 2015

Related U.S. Application Data

(60) Provisional application No. 61/763,862, filed on Feb. 12, 2013.

(51) Int. Cl.

| | |
|---|---|
| ***E21B 43/24*** | (2006.01) |
| ***C10G 1/02*** | (2006.01) |
| ***E21B 43/40*** | (2006.01) |

(52) U.S. Cl.

CPC ..... *E21B 43/24* (2013.01); *C10G 1/02* (2013.01); *E21B 43/40* (2013.01); *C10G 2400/02* (2013.01)

(58) Field of Classification Search

CPC ..... C10G 1/02; C10G 2400/02; E21B 43/24; E21B 43/40

See application file for complete search history.

(56) References Cited

U.S. PATENT DOCUMENTS 3,513,914 A * 5/1970 Vogel ..... E21B 43/24 166/259
2003/0079877 A1* 5/2003 Wellington ..... E21B 43/243 166/272.1

(Continued)

FOREIGN PATENT DOCUMENTS

WO 2014127045 A1 8/2014

OTHER PUBLICATIONS

International Search Report and Written Opinion for International Application No. PCT/US14/16106 filed on Feb. 12, 2014, Applicant: American Shale Oil, LLC, dated May 16, 2014, 6 pages.

(Continued)

*Primary Examiner* — Robert E Fuller
*Assistant Examiner* — Lamia Quaim
(74) *Attorney, Agent, or Firm* — Perkins Coie LLP

(57) ABSTRACT

Devices, systems, and processes are provided for retorting and extracting hydrocarbons from oil shale. A heat transfer fluid includes at least one liquefied petroleum gas (LPG) component such as, for example, propane or butane. The heat transfer fluid moves through a heat delivery loop to retort oil shale, thereby facilitating the production of recoverable hydrocarbons. While the heat transfer fluid moves through the heat delivery loop, cracking of a portion of the heat transfer fluid may produce various hydrocarbon materials that may be provided to a product stream.

17 Claims, 7 Drawing Sheets

(56) References Cited

U.S. PATENT DOCUMENTS

| | | | | |
|---|---|---|---|---|
| 2011/0259590 | A1* | 10/2011 | Burnham | E21B 43/121 166/302 |
| 2011/0308801 | A1* | 12/2011 | Dana | E21B 43/24 166/302 |
| 2013/0000349 | A1* | 1/2013 | Lockhart | C10G 1/002 62/617 |
| 2015/0176380 | A1* | 6/2015 | Vinegar | E21B 43/2401 166/302 |

OTHER PUBLICATIONS

Office Action issued in co-pending Israeli Patent Application No. 240389 dated Apr. 25, 2018, 4 pages.

International Preliminary Report on Patentability issued for International Application No. PCT/US2014/016106, filed Feb. 12, 2014, Applicant: American Shale Oil, LLC, dated Aug. 18, 2015, 5 pages.

* cited by examiner

300

USING LIQUEFIED PETROLEUM GAS IN A HOT CIRCULATING FLUID HEATER FOR IN-SITU OIL SHALE RETORTING

CROSS-REFERENCE TO RELATED APPLICATIONS

This application claims priority from U.S. Provisional Application No. 61/763,862, filed on Feb. 12, 2013, the entirety of which is hereby expressly incorporated herein by reference.

BACKGROUND

Oil shale is a potentially significant source of liquid hydrocarbons. Oil shale is immature petroleum source rock that has not been buried deep enough to generate significant quantities of liquid hydrocarbons. The recovery process often involves heating the oil shale to a temperature in the general range of 300 to 500° C. (degrees Celsius) to convert the native organic matter, primarily kerogen, to oil and gas. The time for this conversion varies with temperature, ranging from, for example, years at 300° C. to minutes at 500° C. Underground (i.e., in situ) processing is typically done at temperatures below 400° C., and aboveground processing (i.e., mining and retorting in a vessel) is typically done at temperatures above 400° C.

There are many variations of in-situ processing. Some involve creating permeability by explosive nibbling, and others involve waiting for thermal conductivity to distribute the heat through the oil shale. Some involve injecting a hot fluid into the formation, and others allow heat to dissipate from a passive heater into the formation. Passive heaters may include, for example, electric heaters, downhole burners, or pipes with recirculating hot fluids. Some variations of the passive heater concept use refluxing oil within the retort to speed the dissipation of the heat from the passive heater into the formation.

Earlier concepts for using a hot recirculating fluid to heat oil shale include using heat transfer fluids such as steam, molten salt, simple gases, Dowtherm® A and Syltherm®, available from the Dow Corning Corporation of Midland, Mich., U.S.A., and Therminol® VP-1, available from the Monsanto Chemical Company, of St. Louis, Mo., U.S.A. Generally, transfer fluids are selected to maximize the amount of heat delivered while the minimizing the amount of pumping costs and parasitic heat loss.

Fixed gases such as nitrogen and carbon dioxide have low heat capacities and, thus, require high temperatures and often significant pumping costs. Synthetic fluids such as Dowtherm® A, Syltherm®, and Therminol® VP-1 have higher heat capacities but also have a maximum operating temperature only slightly above retorting temperature. Consequently, only a small fraction of heat can be delivered each cycle, which may result in significant pumping costs. Steam has the disadvantage that it has to be used at very high pressures to prevent most of its heat from being delivered at sub-retorting temperatures via condensation. Molten salts are corrosive and have operational issues such as solidifying during operational upsets. Other gaseous fluids such as hexafluoroethane have attractive thermodynamic properties but are quite expensive, and some are potent greenhouse gases.

SUMMARY

Embodiments of the invention include devices, systems, and processes for retorting and extracting hydrocarbons from oil shale. In embodiments, a heat transfer fluid includes at least one liquefied petroleum gas (LPG) component such as, for example, propane, butane, or a combination thereof. The heat transfer fluid moves through a heat delivery loop to retort oil shale, thereby facilitating the production of recoverable hydrocarbons. While the heat transfer fluid moves through the heat delivery loop, cracking of a portion of the heat transfer fluid may produce various hydrocarbon materials that may be provided to a product stream.

Figure 1:
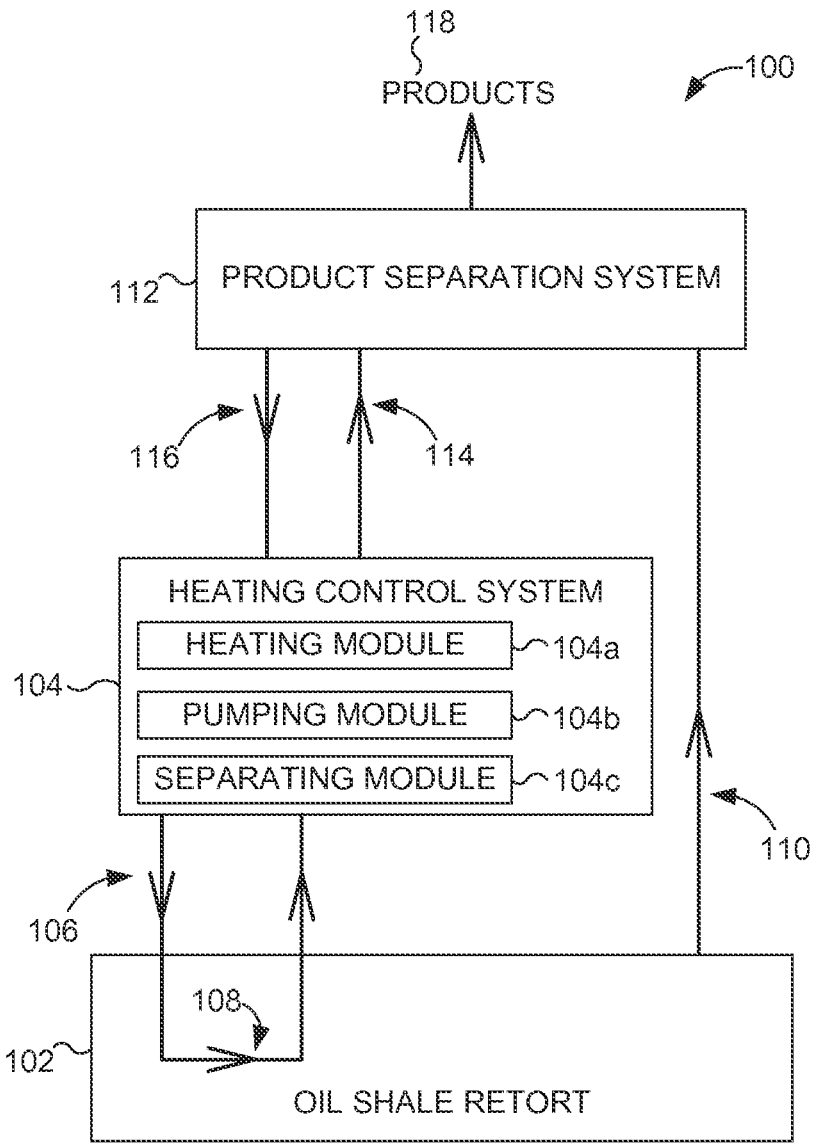
FIG. 1 is a schematic diagram depicting an illustrative hydrocarbon production system in accordance with embodiments of the invention.

While the disclosed subject matter is amenable to various modifications and alternative forms, specific embodiments have been shown by way of example in the drawings and/or are described in detail below. The intention, however, is not to limit the invention to the particular embodiments shown and/or described. On the contrary, the invention is intended to cover all modifications, equivalents, and alternatives falling within the scope of the disclosure as defined by the appended claims.

Although the term "block" may be used herein to connote different elements of illustrative methods employed, the term should not be interpreted as implying any requirement of, or particular order among or between, various steps disclosed herein unless and except when the order of individual steps is explicitly called for.

DETAILED DESCRIPTION

Embodiments of the invention include a variation of a passive heater method that uses hot circulating fluids inside a pipe to create the passive heater while simultaneously deriving some economic value from thermal transformation of the circulating fluid into more valuable products such as, for example, gasoline-range hydrocarbons. According to embodiments, the hot circulating fluid may be used, for example, to retort oil shale, or to apply heat to other types of formations, materials, and the like.

In embodiments, heat transfer fluids are used that are at least partially composed of liquefied petroleum gas (LPG) components such as, for example, propane, butane, or the like. In embodiments, a heat transfer fluid may include a mixture of propane and butane. LPG components typically have substantially higher heat capacities than other simple gases, and they often can operate at higher temperatures than those at which industrial heat transfer fluids can operate. Additionally, LPG components are generally inexpensive and, in fact, are a product of the retorting process.

Cracking of hydrocarbons at high pressures initially forms molecules with both higher and lower molecular weights and establishes a steady state distribution of molecular weights that gradually evolves with time. For example, significant portions of propane and butane may be converted to the gasoline range when used at relatively modest temperature and relatively high pressures, as described, for example, in H. J. Hepp and R. E. Frey, Industrial and Engineering Chemistry, Vol. 45, pp. 410-415 (1953), the entirety of which is hereby expressly incorporated herein by reference for all purposes. If the heavier products are removed from this distribution, the reactions will shift towards reforming the higher molecular weights, thereby enhancing the net yield of larger molecules. At very extreme conditions, the ultimate products are carbon and methane, which would be less valuable than the starting LPG components. Embodiments of the invention operate at conditions under which carbon formation is minimal Additionally, in embodiments, carbon may be removed from the system by a standard refinery furnace-tube cleaning process. In such a process, for example, air may be diluted tenfold or more by a diluent such as steam and passed through the pipe to burn off the carbon in a controlled manner.

FIG. 1 is a schematic diagram depicting aspects of an illustrative hydrocarbon production system 100 in accordance with embodiments of the invention. In embodiments, aspects of the system 100 may be implemented in a drilling operation and may include a refinery, power plant, and/or the like. In embodiments, the illustrative system 100 facilitates an oil shale retorting process by delivering heat energy to an oil shale retort 102 to cause production of recoverable hydrocarbons.

As shown in FIG. 1, embodiments of the system 100 include a heating control system 104 that controls the delivery of heat to the oil shale retort 102 by moving a heat transfer fluid through a heat delivery loop 106. The heat delivery loop 106 may be a closed-loop heating system in which heating fluid and other matter are not transferred more than insubstantially from the heat delivery loop 106 to the oil shale deposit or other external environment, as, for example, would occur in a system that injects steam into the oil shale deposit rather than recycling the steam. The term "loop," as used herein, is not intended to be necessarily limited to a perfect, closed loop, but rather is intended to reflect the circulatory nature of the heat delivery mechanism. That is, for example, heat transfer fluid and other material may be added to, or removed from, the heat delivery loop 106. Additionally, some leakage of heat transfer fluid may occur, for example, at joints or pressure relief valves. The heat transfer fluid may include at least one liquefied petroleum gas (LPG) component such as, for example, propane, butane, or the like. As shown, the heat delivery loop 106 includes a heating zone 108 in which the heat transfer fluid heats the oil shale retort 102 to produce recoverable hydrocarbons, which may be extracted from the oil shale retort 102 as a hydrocarbon product stream 110. In embodiments, the heating zone 108 is disposed along the bottom of the oil shale formation to be retorted.

The heating control system 104 includes a heating module 104*a* configured to heat a heat transfer fluid and a pumping module 104*b* configured to move the heat transfer fluid through the heat delivery loop 106. In embodiments, the pumping module 104*b* may also compress the heat transfer fluid and, for example, the heat transfer fluid may be injected into the heat delivery loop 106 as a supercritical fluid. Components of LPG are formed during the oil shale retorting process. A portion of the LPG components is separated and sent to the heating control system 104, where it is heated and pumped through the heat delivery loop 106. According to embodiments, as the heat transfer fluid moves through the heat delivery loop 106, a portion of the heat transfer fluid (i.e., a portion of the LPG components) may be cracked, e.g., by a thermal cracking process. The cracking process and, in embodiments, secondary reactions, may form a number of materials such as light gases (e.g., hydrogen and methane) and heavier gases (e.g., gasoline-range hydrocarbons such as hydrocarbons in the pentane to octane range). For example, high temperatures and low pressures may form hydrocarbons such as ethylene, while secondary reactions at higher pressures may form larger molecules. In embodiments, the predominant mechanism for formation of the larger molecules (e.g., gasoline-range materials) is a reaction of radicals formed by a variety of mechanisms from propane adding to alkenes formed from earlier reactions. In competition with this synthesis reaction, the larger molecules decompose to smaller molecules. In embodiments, the larger molecules are continually removed at low conversion but the smaller alkenes are not, resulting in a net overall shift to the higher molecular weight products in the final product distribution.

When the heat transfer fluid returns to the surface, it may be processed by a separating module 104*c* configured to separate the LPG components from the materials that resulted from the cracking. In embodiments, the separating module 104*c* cools the returning heat transfer fluid using a countercurrent heat exchanger. This cooling may, for example, operate to convert the heat transfer fluid from a supercritical fluid to a liquid, which may facilitate pumping, separation, and the like. Gasoline-range materials may be condensed and sent to a product separation system 112 as part of a purge stream 114. LPG components and some lighter components may be condensed and separated from hydrogen and methane, which may be sent to the product separation system 112 as part of the purge stream 114. In embodiments, the purge stream 114 may include separate streams for gasoline-range materials and light gases (e.g., methane and hydrogen), and, in embodiments, any number of different streams may be included within the purge stream 114. The condensed LPG components may be pumped back into the retort, first being reheated, for example, by countercurrent heat exchange with the out-coming LPG components and a boost heater. Additional LPG components may be provided, via an input stream 116, to make up for the mass converted to hydrogen, methane, and gasoline. Additionally, an input stream 116 may include fuel gases used by the heating module 104*a* to generate heat. In embodiments, the gasoline-range materials and lighter gases may be provided to the product separation system 112 via the hydrocarbon product stream 110 such as, for example, when a heater is operating on the same pad as the production well.

Figure 6:
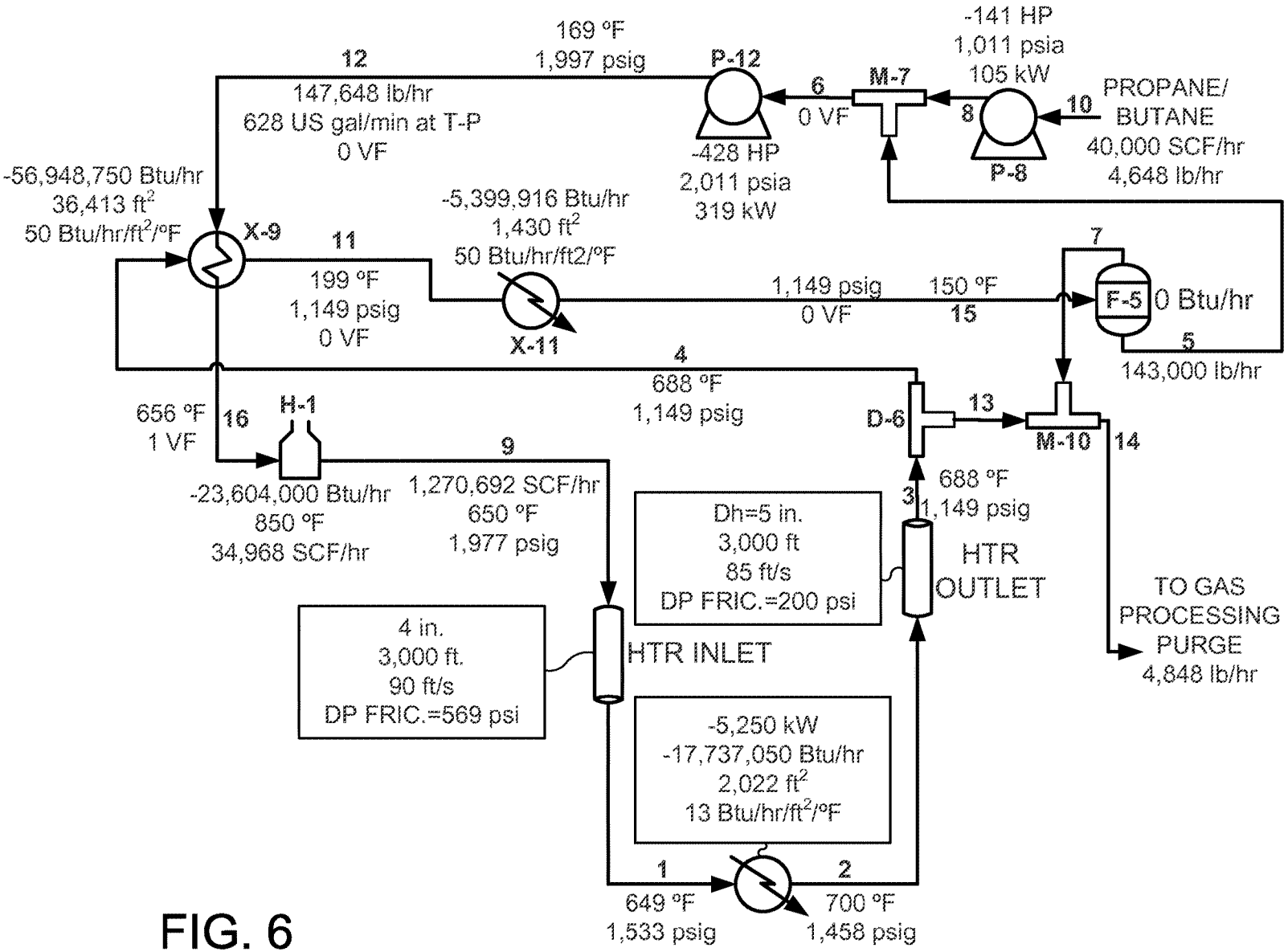
FIG. 6 is a schematic process flow diagram depicting an example of a process simulation in accordance with embodiments of the invention.
Figure 7:
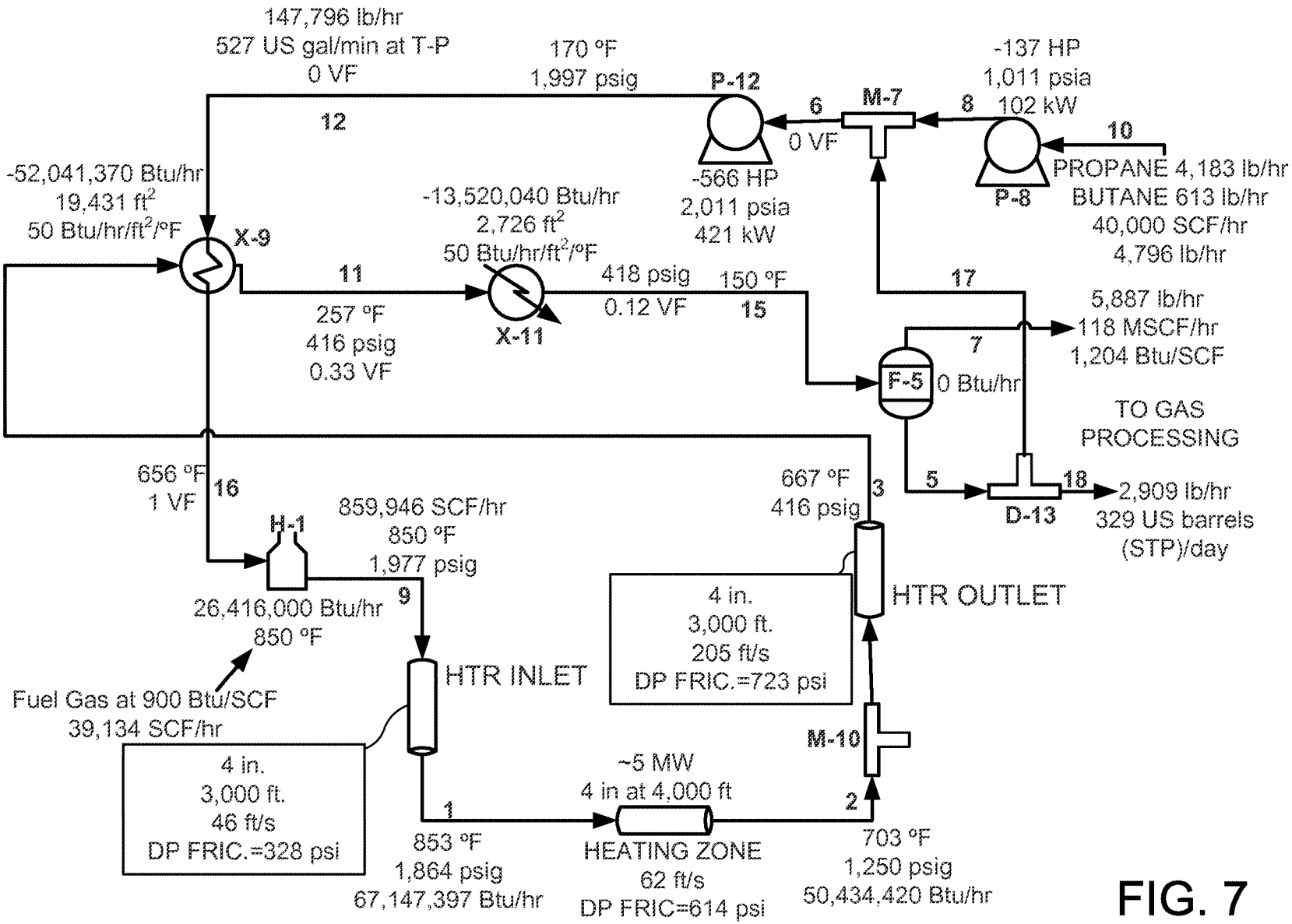
FIG. 7 is a schematic process flow diagram depicting another example of a process simulation in accordance with embodiments of the invention.

The product separation system 112 may produce products 118 such as, for example, synthetic crude, refined products, or the like. The product separation system 112 may include equipment for performing any number of processes such as, for example, gas separation, hydrocarbon separation, hydroprocessing, water treatment, and the like. In embodiments, the materials extracted from the heat transfer fluid and provided to the product separation system 112 may be added to the product stream and, for example, become components of end products. Examples of operations of embodiments of the heating control system 104 are depicted in FIGS. 6 and 7, and described below.

The illustrative system 100 shown in FIG. 1 is not intended to suggest any limitation as to the scope of use or functionality of embodiments of the subject matter disclosed herein. Neither should the illustrative system 100 be interpreted as having any dependency or requirement related to any single component or combination of components illustrated therein. For example, in embodiments, the illustrative system 100 may include a subset of the components illustrated therein, additional components, and the like. Additionally, any one or more of the components depicted in FIG. 1 can be, in embodiments, integrated with various ones of the other components depicted therein (and/or components not illustrated). Any number of other components or combinations of components can be integrated with the illustrative system 100 depicted in FIG. 1, all of which are considered to be within the ambit of the invention.

Figure 2:
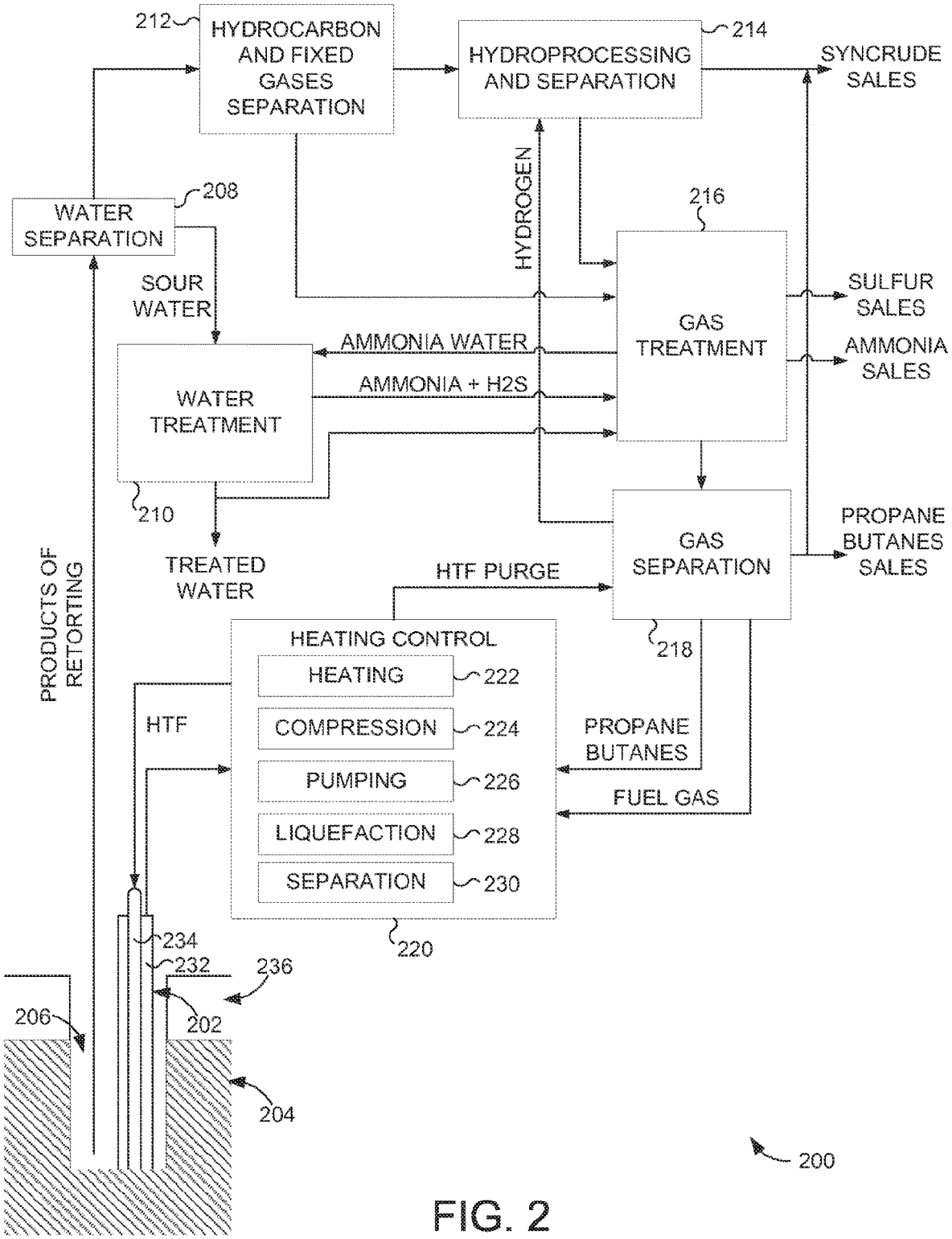
FIG. 2 is a schematic diagram illustrating a process flow in accordance with embodiments of the invention.

FIG. 2 illustrates a process flow 200 for facilitating retorting oil shale to recover hydrocarbons. The illustrated process flow 200 may be accomplished by various devices, apparatuses, and/or systems. In a shale oil recovery process, once the shale oil and associated produce gases are formed, by in-situ or surface retorting, they may be processed near the production site to produce either a synthetic crude oil or finished products for sale or a combination of both. As shown in FIG. 2, a heater casing 202 is exposed to an oil shale formation 204 to deliver heat, from a heat transfer fluid ("HTF") to the formation 204, thereby inducing a retorting process. The products of retorting the oil shale, which include recoverable hydrocarbons, may be recovered from the well bore 206. Recoverable hydrocarbons may include, for example, oil, liquefied petroleum gas (LPG) products, and the like. The products of retorting may be provided to a water separations process 208, which removes sour water from the product stream. A water treatment process 210 may be used to treat the sour water. Treated water can be provided to reservoirs, other portions of the production process 200, cooling systems, or the like.

The remaining retorting products may be provided to a hydrocarbon and fixed gases separation process 212, which separates fixed gases such as, for example, ammonia, from the product stream. A hydroprocessing and separation process 214 may be used to create products such as, for example, synthetic crude or refined products. Gases separated from the hydrocarbon product stream by the hydroprocessing and separation process 214 may be provided to a gas treatment process 216. Gases may also be separated from the product stream during the hydrocarbon and fixed gases separation process 212 and provided to the gas treatment process 216. Additionally, as shown in FIG. 2, gases such as, for example, ammonia and hydrogen sulfide may be provided to the gas treatment process 216 by the water treatment process 210. In embodiments, outputs of the gas treatment process 216 may include ammonia water, which can be treated by the water treatment process 210 and treated water may be provided to the gas treatment process 216 to facilitate treatment of particular gases. The gas treatment process 216 may remove, for example, ammonia and sulfur, which can be output as saleable products.

The gas treatment process 216 may further output treated gases to a gas separation process 218, which may be used, for example, to separate hydrogen from LPG components such as propane and butane. In embodiments, separated hydrogen may be provided to the hydroprocessing and separation process 214, for example, to facilitate hydroracking or other processes. Portions of separated LPG components may be output as saleable products or combined with other hydrocarbon products. Additionally, portions of separated LPG components may be provided to a heating control process 220, where they may be added to a heat transfer fluid. Additionally, the gas separation process 218 may provide fuel gas to a heating control process 220. Fuel gas may be used, for example, by a heating process 222 (e.g., in a furnace) for heating heat transfer fluid.

As shown in FIG. 2, the heating control process 220 may also include a compression process 224, a pumping process 226, a liquefaction process 228, and a separation process 230. The compression process 224 may be used, for example, for compressing heat transfer fluid before injection into a heat delivery loop (e.g., the heat delivery loop 106 illustrated in FIG. 1). In embodiments, for example, the heating process 222 and the compression process 224 may be used to convert the heat transfer fluid to a supercritical fluid before injection, via the pumping process 226, into the heat delivery loop. In embodiments, the heating process 222 and pumping process 226 may consist simply of a fired furnace and a liquid propane pump. Additionally, in embodiments, the heating process 222 may include a countercurrent heat exchanger that heats heat transfer fluid using countercurrent heat exchange with products of retorting that are recovered from the well 206.

While moving through the heat delivery loop, a portion of the heat transfer fluid may undergo thermal cracking, producing a number of materials (e.g., gasoline-range hydrocarbons, methane, hydrogen, and the like). The heat transfer fluid, containing the remaining LPG components and the materials produced from the thermal cracking, exits the well via an outer heat transfer fluid channel 232 and is provided to the heating control process 220. The liquefaction 228 and separation 230 processes may be used to purge a portion of the heat transfer fluid. For example, materials produced from the cracking of LPG components, as well as portions of the LPG components themselves, may be purged from the circulating heat transfer fluid. As shown, this purge stream may be provided to the gas separation process 218. In embodiments, only a small fraction of the circulating heat transfer fluid is purged, while the majority is re-circulated through the heat delivery loop. To maintain a constant, or otherwise desired, volume of heat transfer fluid, LPG components received from the gas separation process 218 (e.g., produced from the retorting process) may be added to the heat transfer fluid to make up for the amount of heat transfer fluid that was cracked and/or purged. In embodiments, various dynamic control processes may be employed to maintain a constant or desired volume and/or composition of the heat transfer fluid.

The heat delivery loop may include an inner heat transfer fluid channel 234, by which heat transfer fluid is delivered to the oil shale formation 204. As shown in FIG. 2, the inner channel 234 and the outer channel 232 may be encased in a heater casing 202, which is disposed in the well bore 206. A portion of the heater casing 202 may be insulated with material such as, for example, an aerogel-based insulation, thereby minimizing heat loss to the overburden 236. In embodiments, the heater casing 202 may be disposed in a heater well, while hydrocarbons are recovered from an at least partially separate production well. Various combinations of heater wells and production wells may be used to facilitate various types of oil shale production processes such as are described, for example, in U.S. Pat. No. 7,743,826, filed Jan. 19, 2007 (issued Jun. 29, 2010); U.S. Pat. No. 7,921,907, filed May 13, 2010 (issued Apr. 12, 2011); U.S.

Pat. No. 8,162,043, filed Mar. 3, 2011 (issued Apr. 24, 2012); U.S. Publication No. 2011/0259590, filed May 13, 2010 (application Ser. No. 12/779,826); and U.S. Publication No. 2012/0205109, filed Nov. 2, 2009 (application Ser. No. 13/127,969), all of which are assigned to American Shale Oil, LLC, of Rifle, Colo., U.S.A., the entirety of each of which is hereby expressly incorporated herein by reference.

The illustrative process flow 200 shown in FIG. 2 is not intended to suggest any limitation as to the scope of use or functionality of embodiments of the subject matter disclosed herein. Neither should the illustrative process flow 200 be interpreted as having any dependency or requirement related to any single process or combination of processes illustrated therein. For example, in embodiments, the illustrative process flow 200 can include a subset of the processes illustrated therein, additional processes, and the like. Additionally, any one or more of the processes depicted in FIG. 2 can be, in embodiments, integrated with various ones of the other processes depicted therein (and/or components not illustrated). Similarly, any one or more of the processes depicted in FIG. 2 may include additional processes. Any number of other processes or combinations of processes can be integrated with the illustrative process flow 200 depicted in FIG. 2, all of which are considered to be within the ambit of the invention.

Figure 3:
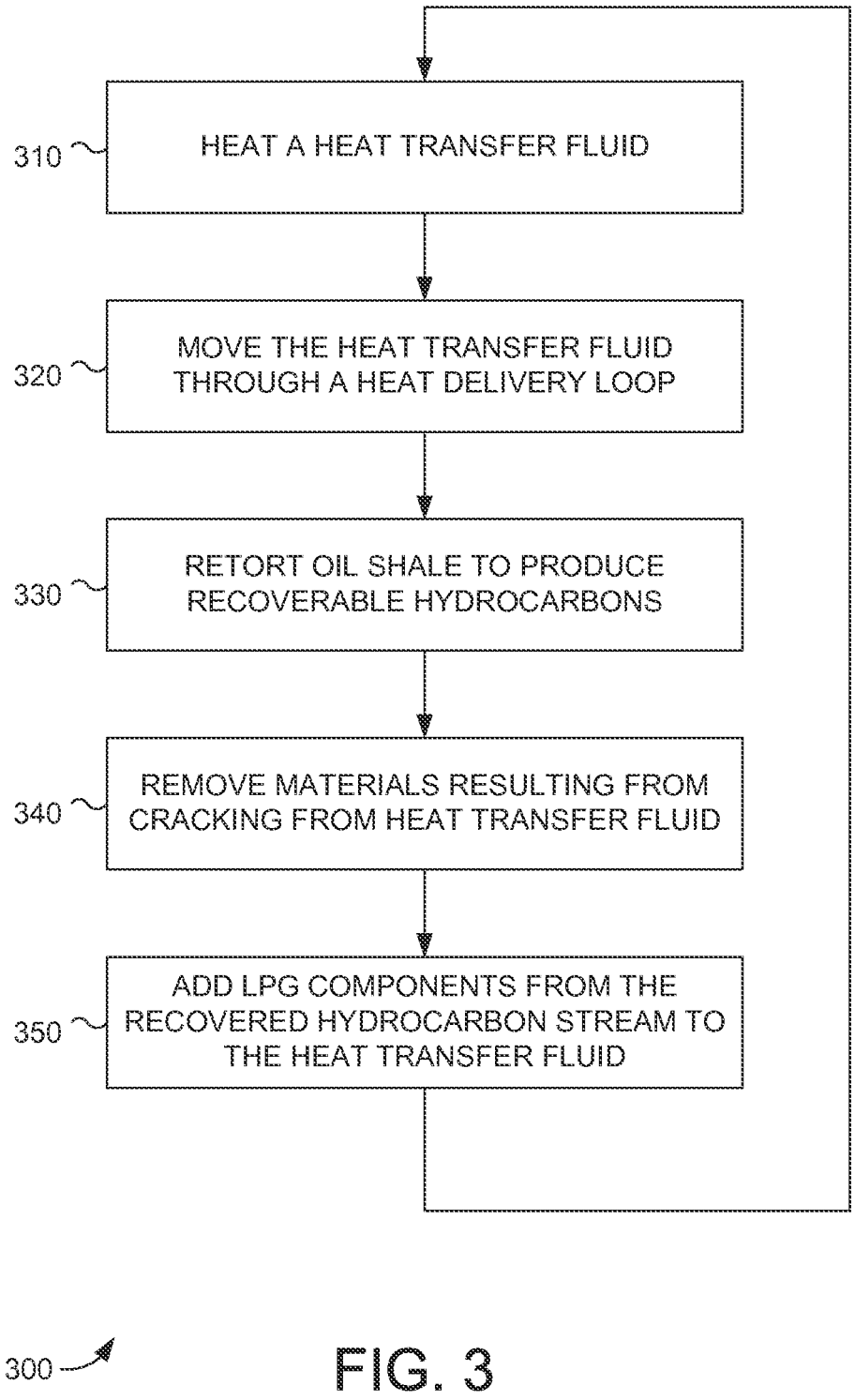
FIG. 3 is a flow diagram depicting an illustrative method for retorting and extracting hydrocarbons from oil shale in accordance with embodiments of the invention.

According to various embodiments of the invention, aspects of the processes and systems described herein may utilize heat transfer fluid containing one or more LPG components to facilitate retorting oil shale to recover hydrocarbons. FIG. 3 is a flow diagram depicting an illustrative method 300 for retorting and extracting hydrocarbons from oil shale in accordance with embodiments of the invention. As shown in FIG. 3, embodiments of the illustrative method 300 include heating, for a first time, a heat transfer fluid (block 310) that includes a first volume of at least one liquefied petroleum gas (LPG) component (e.g., propane, butane, or a combination thereof). As used throughout this disclosure, the phrases "for a first time" and "for a second time" are not intended to be limited to an absolute first and second time, respectively, but instead are merely used to illustrate the cyclical nature of embodiments of the method 300. That is, for example, "heating, for a first time, a heat transfer fluid" may actually refer to a fourth, tenth or hundredth time of heating the heat transfer fluid.

Embodiments of the illustrative method 300 also include moving, for a first time, the heat transfer fluid through a heat delivery loop (block 320). A first portion of the heat transfer fluid is cracked while moving through the heat delivery loop, thereby forming a plurality of materials such as, for example, gasoline-range materials, methane, hydrogen, and the like. In embodiments, materials may be formed as a result of one or more chemical processes such as cracking, reforming, and/or a combination of these or other chemical processes. The heat from the heat transfer fluid is used to retort an oil shale formation to produce recoverable hydrocarbons (block 330). The recoverable hydrocarbons may include a second volume of the at least one LPG component.

In embodiments of the method 300, a portion of the plurality of materials is removed from the heat transfer fluid (block 340). As the term is used herein, "a portion" may refer to a part (e.g., less than the whole) or the whole (e.g., the entire portion). Thus, for example, removing a portion of the plurality of materials may refer to removing all of the plurality of materials or a part of the plurality of materials, and the part of the plurality of materials may include parts of one or more of the different materials. For example, as described above, portions of gasoline-range materials, propane, butane, methane, hydrogen, and the like, may be provided to the product stream. LPG components from the recovered hydrocarbon stream may be added to the heat transfer fluid (block 350), for example, to replace volume reduced from cracking and purging. As shown in FIG. 3, by the arrow connecting block 350 to block 310, embodiments of the method 300 may include heating, for a second time, the heat transfer fluid (block 310) and moving, for a second time, the heat transfer fluid through the heat delivery loop (block 320). Similarly, the remaining steps depicted in FIG. 3 (blocks 330-350) may also be repeated, as embodiments of the illustrative method 300 contemplate a cyclical process.

According to embodiments, the heat delivery loop (e.g., heat delivery loop 106 illustrated in FIG. 1) may also be used to extract heat from the oil shale retort. Heat remaining in the oil shale retort after the hydrocarbons have been recovered may contribute to environmental hazards such as, for example, by heating an aquifer above the oil shale formation, causing barrier minerals to be released into ground water, or the like. Thus, removing at least a portion of the remaining heat from the oil shale retort after production may help to minimize environmental impact. Additionally, the recovered heat may be used, for example, to heat other process fluids, to generate electricity, or the like. In embodiments, heat may be recovered from the retort by moving a heat recovery fluid (e.g., a cold gas) through the heat delivery loop, which absorbs heat from the oil shale retort as it moves through the heating zone. In embodiments, other types of fluids (e.g., liquids) may be used for recovering heat from the retort.

Figure 4:
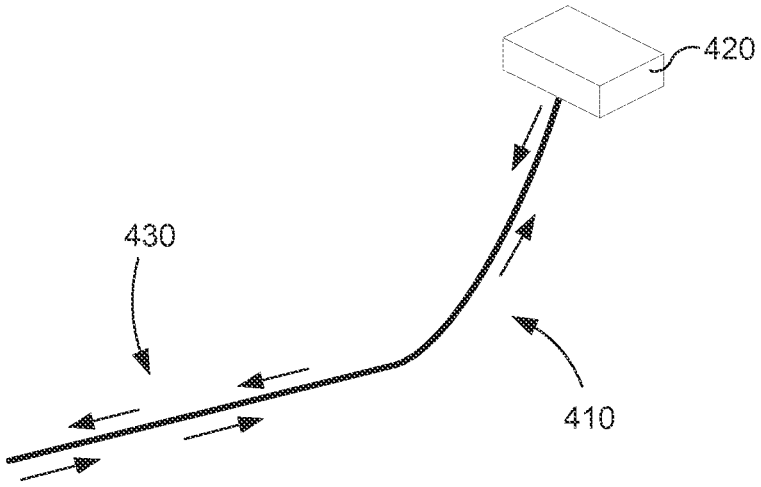
FIG. 4 is a schematic diagram illustrating an "L"-shaped heat delivery loop in accordance with embodiments of the invention.
Figure 5:
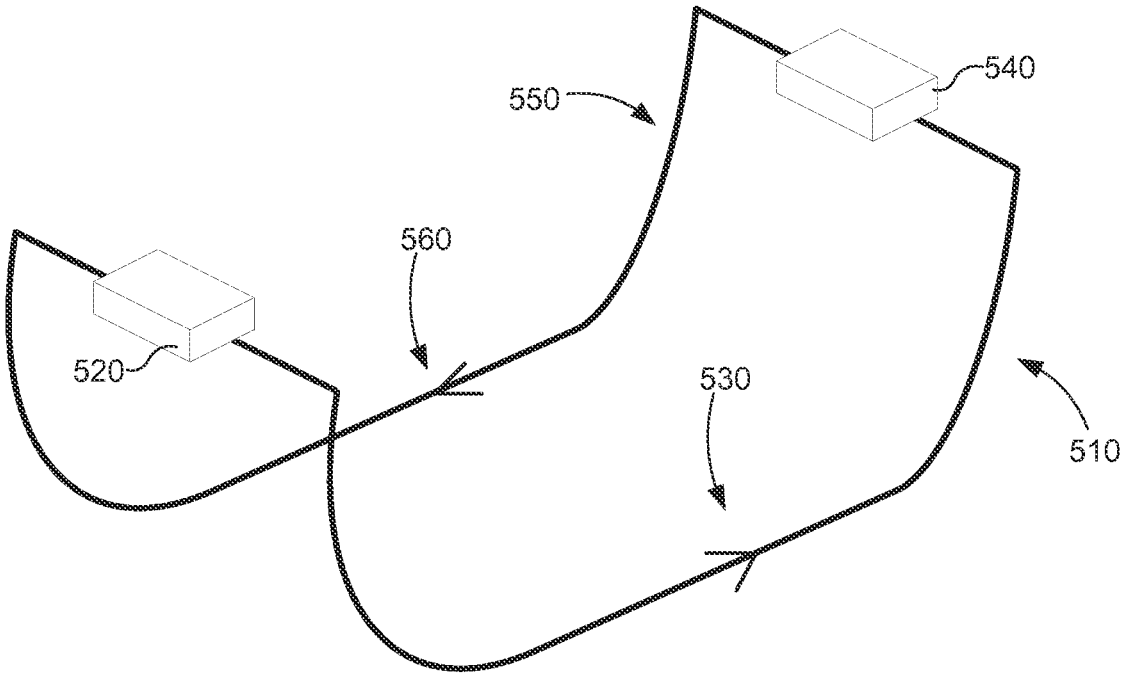
FIG. 5 is a schematic diagram illustrating a "U"-shaped heat delivery loop in accordance with embodiments of the invention.

Embodiments of the retorting technologies described herein may be implemented in any number of different well-site configurations. For example, as shown in FIGS. 4 and 5, the heat delivery loop may include an L-shaped or U-shaped heater well. Other shapes also may be employed such as, for example, a "J"-shaped heater well.

FIG. 4 illustrates an "L"-shaped heater well configuration in accordance with embodiments of the invention. As shown, a heater casing 410, having a general "L"-shaped configuration, descends from a surface station 420 that may include, for example, a heating control system (e.g., heating control system 104 illustrated in FIG. 1), or aspects thereof. The heater casing 410 houses at least a portion of a heat delivery loop. The heat delivery loop includes a heating zone 430, in which heat from the heat transfer fluid is provided to an oil shale retort (e.g., oil shale retort 102 illustrated in FIG. 1). In embodiments, for example, the heating zone 430 may be used to provide heat to a lateral retort, which may extend for thousands of feet (e.g., 2000 feet, 4000 feet, or the like).

FIG. 5 illustrates an alternative heater well configuration according to embodiments of the invention. As shown, a first heater casing 510, having a general "U"-shaped configuration descends from a first surface station 520 to a heating zone 530, and ascends to a second surface station 540. A second heater casing 550, having a general "U"-shaped configuration descends from the second surface station 540 to a heating zone 560, and ascends to the first surface station 520. In embodiments, the heat delivery loop includes the first and second heater casings 510 and 550, with heat transfer fluid circulating, for example, in the direction of the illustrated arrows. The surface stations 520 and 540 may include heating control systems (e.g., heating control system 104 illustrated in FIG. 1) or aspects thereof. For example, in embodiments, both stations 520 and 540 may include heaters, with only one of the stations 520 or 540 including separation systems. In another example, both stations 520 and 540 may include separation systems. According to embodiments, "U" configurations may facilitate using smaller diameter well bores. For example, a pair of heater casings 510 and 550, each having a diameter of between four and six inches, may be used to provide between 5 and 11 megawatts of heat energy to a 4,000 foot lateral heating zone, although specific designs may be determined based on characteristics of heat transfer to the oil shale, desired production characteristics, and the like.

FIG. 6 is a schematic process flow diagram depicting an example of a process simulation for a 5.25 MW heater. The temperature of the LPG going into the retort interval is 849° F. and the temperature leaving the retort interval is 700° F. In the example of FIG. 6, heat transfer fluid is moved through an insulated line (HTR INLET) into a heating well and travels (1) into a heating zone, indicated by heat exchanger (X-4), which represents the oil shale formation to be heated. The heat transfer fluid moves (2) out of the well through the HTR OUTLET, and a portion 13 is purged from the stream at (D-6). The remaining heat transfer fluid is provided (4) to a feed-affluent heat exchanger (X-9) that condenses the heat transfer fluid into a condensed liquid (zero vapor fraction, VF), which is cooled by heat exchanger (X-11) and provided (15) to separator vessel (F-5), which separates hydrogen and methane from the heat transfer fluid. The hydrogen and methane is purged (7/14) and the remaining heat transfer fluid (propane and butane) is provided (5) to a pressurizer or pump (P-12), where it is pressurized. The pressurized heat transfer fluid moves (1) to a fired heater (H-1), which heats the heat transfer fluid before it is re-injected (9) into the well through the insulated line (HTR INLET). A make-up stream of liquefied propane and butane is provided (10), via pump (P-8), to the system to balance the loss from purging. In embodiments, any number of various configurations of equipment can be used to achieve various goals. Selective purging of materials may be used at various different points in the process flow. For example, a separator could be placed in stream (11) to selectively purge a gasoline fraction of the stream.

FIG. 7 is a schematic process flow diagram depicting another example of a process simulation. The illustrated process flow of FIG. 7 is largely similar to that of FIG. 6; however, FIG. 7 includes various changes. For example, approximate products of reaction have been added to FIG. 7. Additionally, the purge stream is moved to the liquid separator liquid stream and part of the vapor stream. The heat exchanger module use to simulate the heating zone is replaced by a line module that can calculate both heat loss and line pressure drop. As with the example simulation of FIG. 6, approximately 5 MW of energy are available within the constraints of the model.

Figure 8:
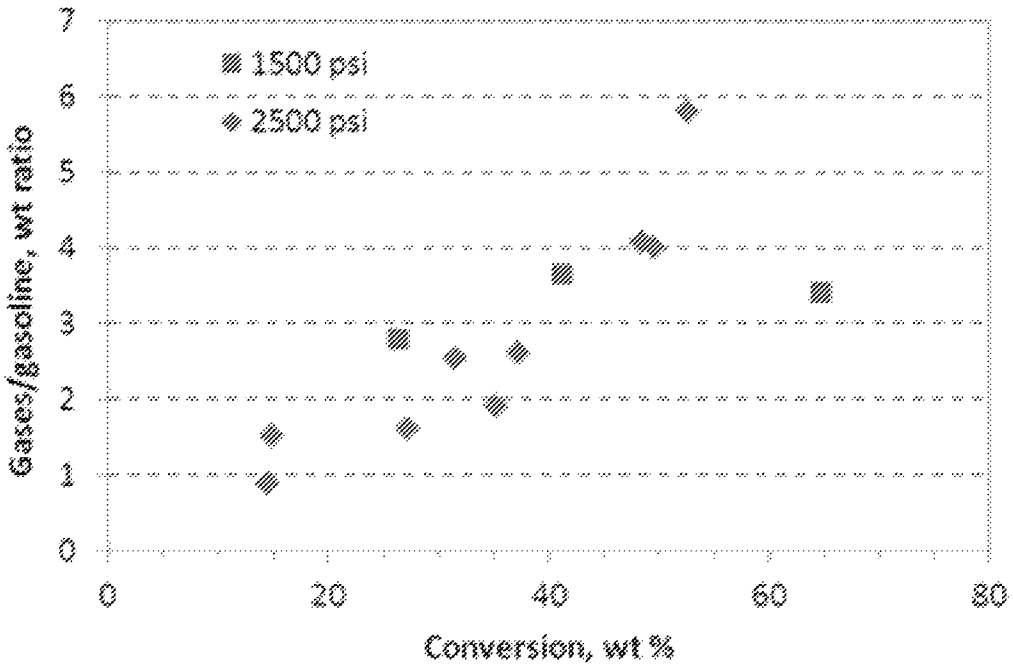
FIG. 8 is a data plot indicating a ratio of gaseous to gasoline products from propane cracking at various pressures in accordance with embodiments of the invention.

In embodiments, data from H. J. Hepp and R. E. Frey, Industrial and Engineering Chemistry, Vol. 45, pp. 410-415 (1953), can be used to optimize the economic gain of the process. The ratio of gaseous to gasoline products from propane cracking at relevant pressures is shown in FIG. 8. For conditions under which less than 10% by weight of the propane is cracked, the amount of gasoline formed is more than the amount of other gaseous species. The data in FIG. 8 are for conditions in which no products are removed during the course of the reaction. The predominant mechanism for formation of these larger molecules is the reaction of radicals formed by a variety of mechanisms from propane adding to alkenes formed from earlier reactions. In competition with this synthesis reaction, the larger molecules decompose to smaller molecules. Hence, if the larger molecules are continuously removed at low conversion but the smaller alkenes are not, there will be a net overall shift to the higher molecular weight products in the final product distribution.

While embodiments of the present invention are described with specificity, the description itself is not intended to limit the scope of the invention. Rather, the inventors have contemplated that the claimed invention might also be embodied in other ways, to include different steps or features, or combinations of steps or features similar to the ones described in this document, in conjunction with other technologies. For example, the plumbing and equipment used to deliver the heat transfer fluid to an oil shale formation may also be used to extract heat from the formation after the completion of oil and gas extraction. The extracted heat could then be used directly to heat other process fluids, or with the addition of, for example, a gas turbine or other heat engine, may be used to generate electricity. In the latter case, the heat transfer fluid may be pumped down to the retort interval cool, heated downhole, and then either expand directly through the heat engine or undergo heat exchange with another working fluid (e.g., supercritical CO2) that is used to drive the heat engine. In embodiments, a thermoelectric conversion device may be utilized for heat exchange.

The following is claimed:

1. A method for retorting and extracting hydrocarbons from oil shale, the method comprising:

heating, for a first time, a heat transfer fluid, wherein the heat transfer fluid comprises a first volume of at least one liquefied petroleum gas (LPG) component;

moving, for a first time, the heat transfer fluid through a heat delivery loop, wherein a first portion of the heat transfer fluid is cracked while moving through the heat delivery loop, thereby forming a plurality of materials;

retorting in-situ, using heat from the heat transfer fluid, an oil shale formation to produce recoverable hydrocarbons, wherein the recoverable hydrocarbons include a second volume of at least one LPG component;

removing a portion of the plurality of materials from the heat transfer fluid;

heating, for a second time, the heat transfer fluid; and moving, for a second time, the heat transfer fluid through the heat delivery loop.

2. The method of claim 1, wherein the at least one LPG component comprises at least one of propane and butane.

3. The method of claim 1, further comprising adding a portion of the second volume of at least one LPG component to the heat transfer fluid.

4. The method of claim 1, wherein heating, for the second time, the heat transfer fluid comprises heating the heat transfer fluid using a countercurrent heat exchange with recovered hydrocarbons.

5. The method of claim 1, further comprising providing the portion of the plurality of materials to a product separation system.

6. The method of claim 5, wherein the portion of the plurality of materials comprises a gasoline-range hydrocarbon.

7. The method of claim 5, further comprising:

receiving a third volume of at least one LPG component from the product separation system; and adding the third volume of at least one LPG component to the heat transfer fluid.

8. The method of claim 1, further comprising moving a heat recovery fluid through the heat delivery loop to extract heat from the in-situ oil shale formation.

9. A hydrocarbon production system, comprising:

a heat delivery loop through which a heat transfer fluid moves, wherein the heat transfer fluid comprises at least one liquefied petroleum gas (LPG) component, the heat delivery loop comprising a heating zone in which the heat transfer fluid heats an oil shale formation in-situ to produce recoverable hydrocarbons, wherein a first portion of the heat transfer fluid is cracked while moving through the heat delivery loop, thereby forming a plurality of materials; and a heating control system comprising: (1) a heating module configured to heat the heat transfer fluid, (2) a pumping module configured to pump the heat transfer fluid into the heat delivery loop, and (3) a separating module configured to separate a portion of the plurality of materials from the heat transfer fluid.

10. The system of claim 9, wherein the at least one LPG component comprises at least one of propane and butane.

11. The system of claim 9, further comprising a product separation system configured to produce hydrocarbon products.

12. The system of claim 9, wherein the plurality of materials comprises gasoline-range hydrocarbons.

13. The system of claim 12, wherein the separating module is configured to:

condense the gasoline-range hydrocarbons;

provide the condensed gasoline-range materials to the product separation system;

condense the at least one LPG component;

separate the at least one LPG component from at least one of hydrogen and methane; and provide the at least one of the hydrogen and methane to the product separation system.

14. The system of claim 13, wherein the separating module is further configured to provide the at least one LPG component to the heating module.

15. The system of claim 9, wherein the heating module comprises at least one of a countercurrent heat exchanger and a furnace.

16. The method of claim 1, wherein the first portion of the heat transfer fluid is cracked while moving through a portion of the heat delivery loop that passes through the oil shale formation.

17. The system of claim 9, wherein the first portion of the heat transfer fluid is cracked while moving through a portion of the heat delivery loop that passes through the oil shale formation.

* * * * *